US005877595A

United States Patent [19]

Nerone

[11] Patent Number: 5,877,595

[45] Date of Patent: Mar. 2, 1999

[54] HIGH POWER FACTOR BALLAST CIRCUIT WITH COMPLEMENTARY CONVERTER SWITCHES

[75] Inventor: Louis R. Nerone, Brecksville, Ohio

[73] Assignee: General Electric Company, Schenectady, N.Y.

[21] Appl. No.: 975,309

[22] Filed: Nov. 21, 1997

Related U.S. Application Data

[63] Continuation-in-part of Ser. No. 810,495, Feb. 28, 1997, Pat. No. 5,838,117, Ser. No. 841,987, Apr. 8, 1997, and Ser. No. 709,063, Sep. 6, 1996.

[51] Int. Cl.[6] ..... H05B 37/00; H05B 37/02; H05B 41/00

[52] U.S. Cl. ..... 315/209 R; 315/307; 315/DIG. 7; 315/DIG. 5; 315/289; 315/290

[58] Field of Search ..... 315/DIG. 7, 307

[56] References Cited

U.S. PATENT DOCUMENTS

| | | | |
|---|---|---|---|
| 4,370,600 | 1/1983 | Zansky | 315/244 |
| 4,463,286 | 7/1984 | Justice | 315/219 |
| 4,546,290 | 10/1985 | Kerekes | 315/209 R |
| 4,588,925 | 5/1986 | Fahnrich et al. | 315/101 |
| 4,614,897 | 9/1986 | Kumbatovic | 315/224 |
| 4,647,817 | 3/1987 | Fahnrich et al. | 315/104 |
| 4,677,345 | 6/1987 | Nilssen | 315/209 R |
| 4,692,667 | 9/1987 | Nilssen | 315/209 R |
| 4,937,470 | 6/1990 | Zeller | 307/270 |
| 4,945,278 | 7/1990 | Chern | 315/209 R |
| 5,223,767 | 6/1993 | Kulka | 315/209 R |
| 5,309,062 | 5/1994 | Perkins et al. | 315/53 |
| 5,341,068 | 8/1994 | Nerone | 315/219 |
| 5,349,270 | 9/1994 | Roll et al. | 315/209 R |
| 5,355,055 | 10/1994 | Tary | 350/209 R |
| 5,387,847 | 2/1995 | Wood | 315/209 R |
| 5,394,064 | 2/1995 | Ranganath et al. | 315/209 R |
| 5,406,177 | 4/1995 | Nerone | 315/307 |
| 5,514,935 | 5/1996 | Oda et al. | 315/DIG. 7 |
| 5,514,981 | 5/1996 | Tam et al. | 326/80 |
| 5,729,096 | 3/1998 | Liu et al. | 315/209 R |
| 5,751,120 | 5/1998 | Zeitler et al. | 315/DIG. 7 |

OTHER PUBLICATIONS (Anonymous), "Samsung Electronics KA7514A Industrial," Samsung Electronics, Korea (1996), CD–ROM (Edition 3.0), printed as pp. 1–5.

*Primary Examiner*—Don Wong
*Assistant Examiner*—Wilson Lee
*Attorney, Agent, or Firm*—Charles E. Bruzga, Esq.

[57] ABSTRACT

A gas discharge ballast circuit comprises a resonant load circuit including a resonant inductance, a resonant capacitance, and circuitry for connection to at least one gas discharge lamp. A d.c.-to-a.c. converter circuit is coupled to the load circuit for inducing an a.c. current in the circuit. It comprises first and second converter switches serially connected in the foregoing order between a bus conductor at a d.c. voltage and a reference conductor, and connected together at a common node through which the a.c. load current flows. The first and second converter switches each comprise a control node and a reference node, the voltage between such nodes determining the conduction state of the associated switch. The respective control nodes of the first and second converter switches are interconnected. The respective reference nodes of the first and second converter switches are connected together at the common node. A bridge network is connected between first and second nodes and has first and second input nodes on which respective first and second input signals are applied, and first and second output nodes respectively connected to the common and control nodes so as to control the switching state of the converter switches. An oscillator provides the first and second input signals. A boost capacitor is coupled between the bus and reference conductors. A boost inductor is supplies energy to the boost capacitor. A boost switch intermittently couples one end of the boost inductor between the bus and reference conductors so as to store energy in the inductor.

18 Claims, 5 Drawing Sheets

HIGH POWER FACTOR BALLAST CIRCUIT WITH COMPLEMENTARY CONVERTER SWITCHES

This is a continuation-in-part of application Ser. No. 08/810,495, filed on Feb. 28, 1997 U.S. Pat. No. 5,838,117, a continuation-in-part of application Ser. No. 08/841,987, filed on Apr. 8, 1997 and a continuation-in-part of application Ser. No. 08/709,063, filed on Sep. 6, 1996.

FIELD OF THE INVENTION

The present invention relates to a high power factor ballast circuit for powering a gas discharge lamp, and, more particularly, to such a ballast circuit employing a pair of complementary switches in a d.c.-to-a.c. converter.

BACKGROUND OF THE INVENTION

Power supply, or ballast, circuits for various loads typically include a converter for supplying a.c. or d.c. current to a load. Such circuits typically include a pair of non-complementary switches in the converter. For example, it is common to use a pair of identical, n-channel enhancement mode MOSFETs as the switches. However, the use of such non-complementary MOSFETs has various drawbacks.

For instance, each of the non-complementary MOSFETs must be controlled by a separate gate-to-source (or control) voltage. This requires level shifting of voltage to couple a single control signal to each of the gate-to-source voltages of the pair of MOSFETs. Such level shifting can be accomplished by a transformer or by conventional bootstrapping means. The transformer method works well at high speeds, e.g., over 20 kilohertz, but is costly and hard to control. The bootstrapping method, usually implemented by an Integrated Circuit (IC), has good control capability, but is unable to work at high speeds, beyond 100 kilohertz.

In accordance with a first aspect of the invention, it would be desirable to provide a ballast circuit for a gas discharge lamp that overcomes the foregoing drawbacks. In accordance with a second aspect of the invention, it would further be desirable for such a ballast circuit to provide a feedback function to synchronize the frequency of lamp current to desired starting and operating frequencies, and also to provide a cathode preheat function. In accordance with a third aspect of the invention, it would be desirable to incorporate with either the first or second aspects of the invention circuitry for achieving a high power factor.

SUMMARY OF THE INVENTION

An exemplary embodiment of the invention provides a gas discharge ballast circuit, comprising a resonant load circuit including a resonant inductance, a resonant capacitance, and circuitry for connection to at least one gas discharge lamp. A d.c.-to-a.c. converter circuit is coupled to the resonant load circuit for inducing an a.c. current in the resonant load circuit. It comprises first and second converter switches serially connected in the foregoing order between a bus conductor at a d.c. voltage and a reference conductor, and connected together at a common node through which the a.c. load current flows. The first and second converter switches each comprise a control node and a reference node, the voltage between such nodes determining the conduction state of the associated switch. The respective control nodes of the first and second converter switches are interconnected. The respective reference nodes of the first and second converter switches are connected together at the common node. A bridge network is connected between first and second nodes and has first and second input nodes on which respective first and second input signals are applied, and first and second output nodes respectively connected to the common and control nodes so as to control the switching state of the converter switches. An oscillator provides the first and second input signals, and has a timing input and an output. A boost capacitor is coupled between the bus and reference conductors. A boost inductor is coupled to supply energy to the boost capacitor. A boost switch intermittently couples one end of the boost inductor between the bus and reference conductors so as to store energy in the inductor.

The foregoing circuit achieves a high power factor, and requires no isolation transformer. When a lamp is removed from the circuit, the output voltage is kept within normal operating bounds. If a lamp breaks, the ballast circuit produces enough current to open up (i.e., burn out) the lamp cathodes, thus limiting the output voltage.

DETAILED DESCRIPTION OF THE INVENTION

Figure 1:
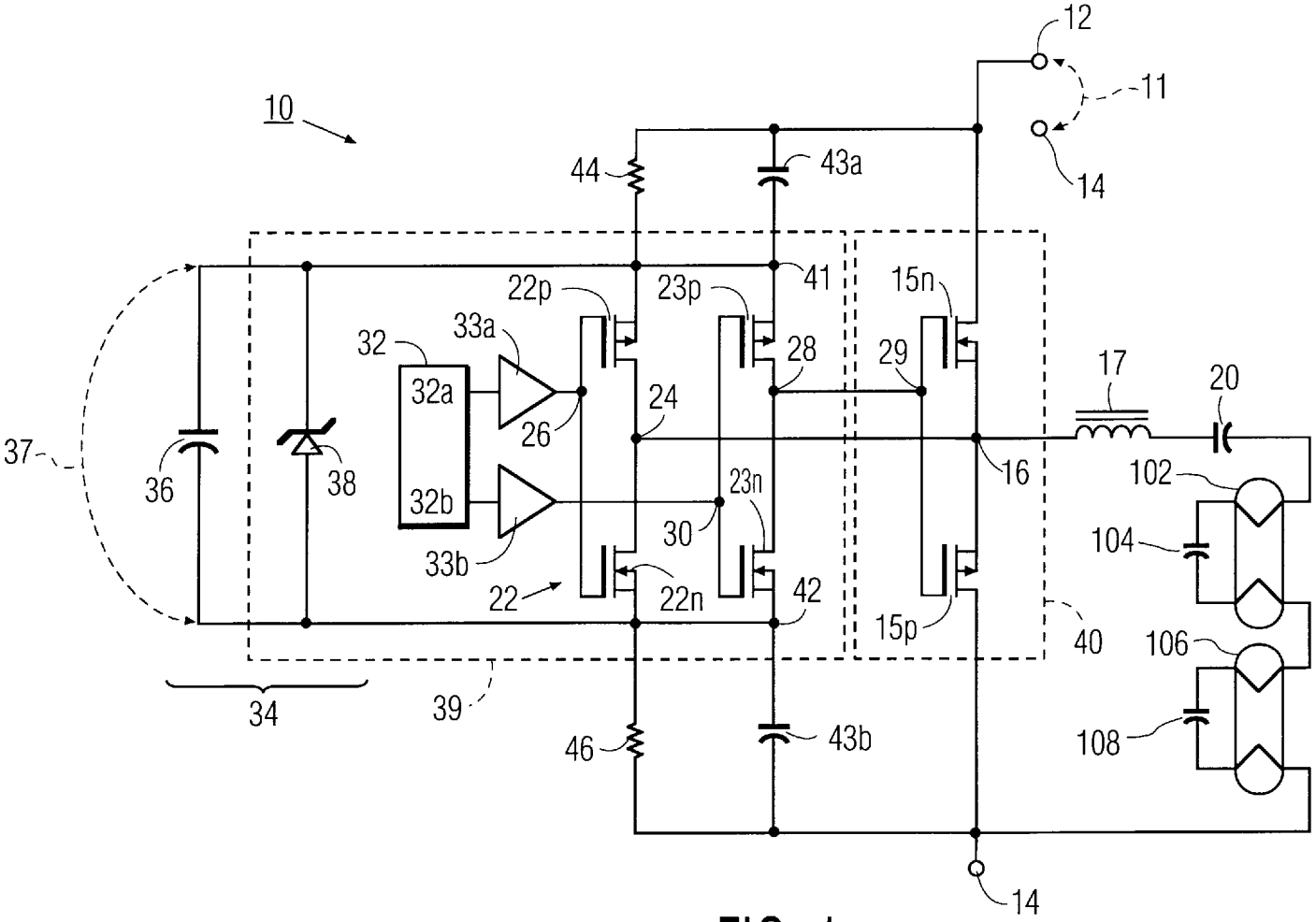
FIG. 1 is a schematic diagram, partially in block form, of an exemplary ballast circuit employing complementary switches in a d.c.-to-a.c. converter, in accordance with the invention.

FIG. 1 shows an exemplary ballast circuit 10 for one or more gas discharge lamps 102 and 106. A d.c. bus voltage 11 is applied to bus conductor 12 with respect to a reference node or conductor 14. The potential of reference conductor 14 is not necessarily at ground; it simply is a potential less than that of bus conductor 12. As shown, ballast circuit 10 employs a pair of switches 15*n* and 15*p* (collectively numbered 40) for implementing a d.c.-to-a.c. conversion. Switch 15*n* may be an n-channel, enhancement mode MOSFET, while switch 15*p* may be a p-channel, enhancement mode MOSFET. Such switches are, therefore, complementary to each other. The sources of MOSFET switches 15*n* and 15*p* are interconnected at common node 16, which node is alternately connected to bus conductor 12 and then to reference conductor 14, and back to bus conductor 12, and so on. Other complementary switches could be used, such as other source-to-source connected MOSFET pairs, Bipolar Junction Transistors, Insulated Gate Bipolar Transistors, MOS-Controlled Thyristors, or Gate Turn-Off devices.

Converter switches 15*n* and 15*p* supply a.c. current to a resonant load circuit preferably comprising a resonant inductor 17 and resonant capacitor 104 shunted across a lamp 102, and capacitor 108 shunted across a lamp 106. The lamps, which may be fluorescent, can be replaced by a single lamp, or more than two serially connected lamps, each preferably shunted by a capacitor. A d.c. blocking capacitor is also provided in the resonant load circuit. Converter switches 15*n* and 15*p* are, in turn, controlled by a bridge network 22 preferably formed of drain-connected, complementary conduction mode MOSFETs, which control the gates of the converter switches.

Specifically, bridge network 22 may comprise a first pair of such MOSFETs designated 22*p* and 22*n* to represent p-channel and n-channel, enhancement mode MOSFETs, respectively; and a second pair of such MOSFETs designated 23*p* and 23*n* for the same reason. As will be appreciated from FIG. 1, each pair 22*p*, 22*n* and 23*p*, 23*n* of MOSFETs have respective interconnected drains and interconnected gates. The drains of pair 22*p*, 22*n* are connected to a first output node 24 of bridge network 22, which is connected to common node 16; the gates of such pair are connected to a first input node 26 of bridge network 22. Similarly, the drains of pair 23*p*, 23*n* are connected to a second output node 28 of bridge network 22, which is connected to a common control node 29 of the converter switches; the gates of such pair are connected to a second input node 30 of bridge network 22. Preferably, pairs 22*p*, 22*n* and 23*p*, 23*n* of bridge network 22 each comprise drain-connected CMOS transistors, which are commonly available.

A first input signal is supplied to first input node 26 by a signal source 32, via a, e.g., non-inverting buffer 33*a*; the first input signal is designated by 32*a* in the block for the signal source. A second input signal is supplied to second input node 30, via a, e.g., non-inverting buffer 33*b*, the second input signal being designated by 32*b* in the block for the signal source. The first and second input signals will be described in detail below.

In accordance with an optional aspect of the invention, an energy source 34 is provided for supplying energy both to power signal source 32 and to supply, via buffers 33*a* and 33*b*, the energy needed to control switch pairs 22*p*, 22*n* and 23*p*, 23*n*. As will be detailed below, during certain modes of operation of converter switches 15*n* and 15*p*, residual energy in resonant inductor 17 is used to replenish energy dissipated by source 34 in performing these powering functions. Energy source 34 may comprise a capacitor 36 and a Zener diode 38.

Beneficially, the circuitry inside of dashed-line box 39 described so far can be incorporated into an integrated circuit (IC) in a hybrid or monolithic form, and the converter switches themselves, enclosed in dashed-line box 42, can also be incorporated into the same IC in a hybrid or monolithic form.

Each of gate control switch pairs 22*p*, 22*n* and 23*p*, 23*n* are connected between a first node 41 at their upper shown-portion, and a second node 42 at their lower-shown portion. A first bootstrap capacitor 43*a* and a bias resistor 44 are connected between first node 41 and bus conductor 12. A second bootstrap capacitor 43*b* and a bias resistor 46 are connected between second node 42 and reference conductor 14.

Bootstrap capacitors 43*a* and 43*b* preferably perform dual functions. One function is to act as a conventional snubber capacitor for the purpose of causing converter switches 15*n* and 15*p* to switch softly, as opposed to abruptly, which considerably reduces energy dissipation in the switches when they change state. The second function of the bootstrap capacitors is a bootstrapping function, wherein residual energy from resonant inductor 17 is used to change the states of charge of the bootstrap capacitors, and in the process to replenish energy of source 34 used in powering signal source 32 and buffers 33*a* and 33*b*. Bootstrap capacitors 43*a* and 43*b*, therefore, are preferably sized to perform the bootstrap function, which may require a larger size than is required merely to perform the snubbing function. The bootstrap operation of the capacitors is detailed below.

Figures 2, 3:
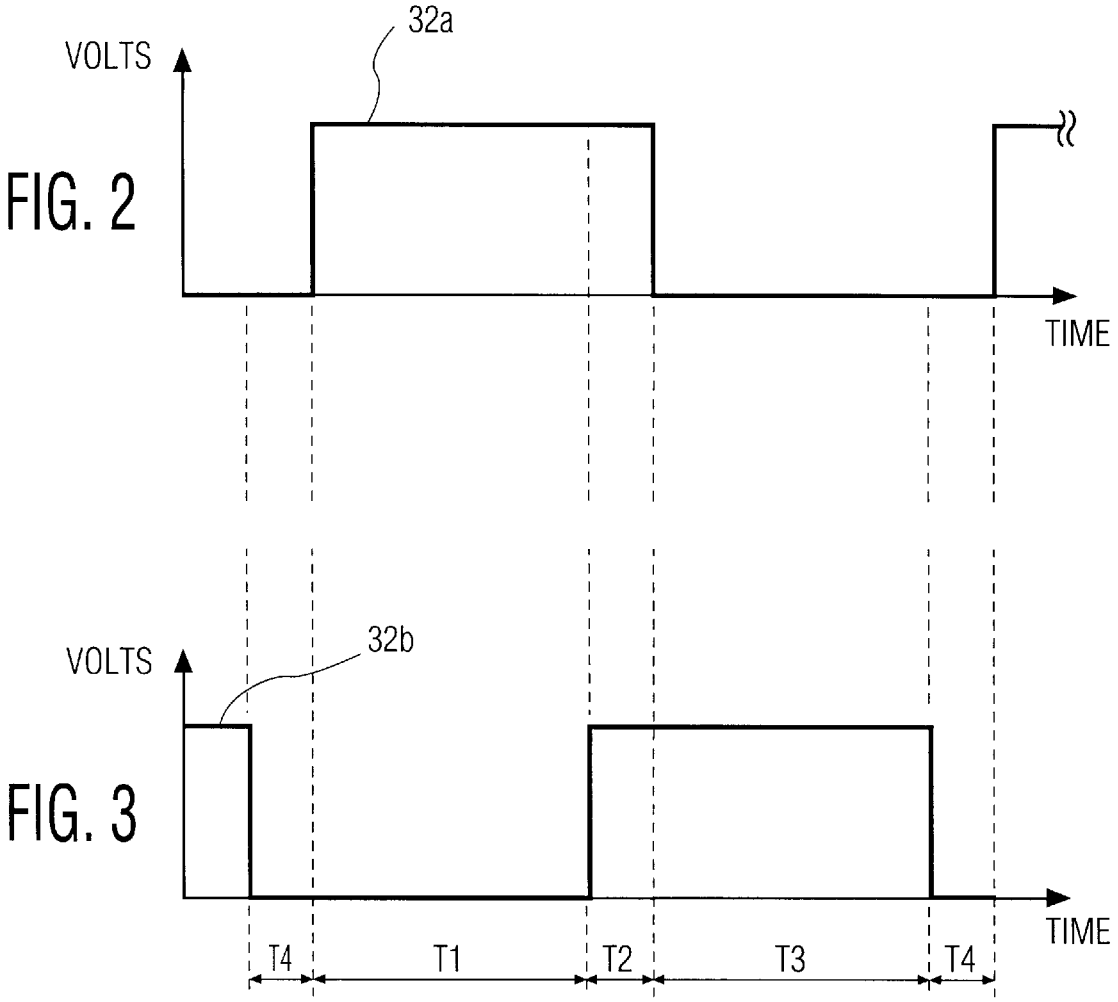
FIGS. 2 and 3 respectively show first and second input signal 32*a* and 32*b* used in the circuit of FIG. 1.

FIGS. 2 and 3 respectively show first and second input signals 32*a* and 32*b* produced by signal source 32 of FIG. 1. These signals vary between "1" (or high) and "0" (or low), which refer to logic levels, whereby logic level "1" may be 5 volts, for example. In accordance with the invention, signal source 32 (FIG. 1) provides input signals pairs 32*a*, 32*b* that repetitively cycle through at least the four illustrated states of 1-0, 1-1, 0-1 and 0-0. These states respectively occur during time periods T1, T2, T3 and T4. As can be seen in FIG. 3, after time period T4, time period T1 begins again. One or more other time periods could be interposed among time periods T1 through T4, and represent different input signal pairs 32*a*, 32*b*, if desired. Operation of ballast circuit 10 of FIG. 1 is now described during each of time periods T1 through T4.

The following table identifies operating states for input signals 32*a* and 32*b*, and the conduction states of transistors 22*p*, 22*n* , 23*p* and 23*n* of bridge network 22. After the table, the conduction states of converter switches 15*n* and 15*p*, and the bootstrap operation of capacitors 43*a* and 43*b*, are described.

| | 32a | 32b | 22p | 22n | 23p | 23n |
|---|---|---|---|---|---|---|
| T1 | 1 | 0 | OFF | ON | ON | OFF |
| T2 | 1 | 1 | OFF | ON | OFF | ON |
| T3 | 0 | 1 | ON | OFF | OFF | ON |
| T4 | 0 | 0 | ON | OFF | ON | OFF |

During time period T1, converter switch 15*n* is on (or conducting) and switch 15*p* is off. During this time, common node 16 is connected to bus conductor 12 so as to be at bus voltage 11, which voltage is impressed across bootstrap capacitor 43*b* by virtue of switch 22*n* being on. Voltages across the capacitors in FIG. 1 are from top-to-bottom. Additionally, bus voltage 11 is impressed across the serially connected capacitors 43*a*, 36 and 43*b*. With voltage 37 being the top-to-bottom voltage across energy source capacitor 36, the foregoing capacitors then respectively have voltages across them of negative voltage 37 of typically −12 volts for capacitor 43*a*, voltage 37 of typically 12 volts for capacitor 36, and bus voltage 11 for capacitor 43*b*.

During time period T2, converter switch 15*n* is turned off, with switch 15*p* remaining off as it was in time period T1. Residual energy in resonant inductor 17 causes current to flow through such inductor from left to right in FIG. 1, such current passing upwardly through second bootstrap capacitor 43*b*, through switch 22*n* which is on at this time, and back to resonant inductor 17. Meanwhile, bus voltage 11 continues to be impressed across the serial combination of capacitors 43*a*, 36 and 43*b*. As a result, the voltage on capacitor 43*b* changes from bus voltage 11 to negative voltage 37 of typically −12 volts, while the voltage on capacitor 43*a* changes from negative voltage 37 of typically −12 volts to bus voltage 11. In this process, charge from capacitor 43*b* is transferred via energy source capacitor 36 to capacitor 43*a*. However, some of the charge from capacitor 43*b* is retained by capacitor 36, so as to replenish energy used in powering signal source 32 and buffers 33*a* and 33*b*.

In the next time period T3, converter switch 15*n* remains off and switch 15*p* is turned on. The voltages across serially connected capacitors 43*a*, 36 and 43*b* remain as set in the preceding time period T2.

In time period T4, switch 15*n* remains off and switch 15*p* is turned off. During this time residual energy in resonant inductor 17 causes current to flow through such inductor from right to left in FIG. 1. With switch 22*p* being on at this time, such current from resonant inductor 17 flows from node 16 to node 24 and upwardly through switch 22*p* to pass through bootstrap capacitor 43*a*. Specifically, the voltage of capacitor 43*a* changes from bus voltage 11 as set in time period T2 to negative voltage 37 of typically −12 volts. Since bus voltage 11 is impressed across the serial combination of capacitors 43*a*, 36 and 43*b*, the voltage of capacitor 43*b* changes in from negative voltage 37 of typically −12 volts set in time period T2, to bus voltage 11, while voltage 37 remains at a nearly constant voltage (e.g. 12 volts). In the process of capacitor 43*b* becoming charged to bus voltage 11, charge is transferred from capacitor 43*a* to capacitor 43*b*. Some charge from capacitor 43*a* is absorbed by energy source capacitor 36 to replenish energy dissipated in powering signal source 32 and buffers 33*a* and 33*b*.

In the foregoing manner, energy source 34 is supplied with residual energy from resonant inductor 17 during switching periods (e.g., T2, T4) when one converter switch is already off and the other is turned off.

To produce the waveforms shown in FIG. 2 for first and second input signals 32*a* and 32*b*, signal source 32 may comprise a conventional square-wave generator for first input signal 32*a*, such as a commonly available 555 IC timer operating in a 50 percent duty ratio mode. To produce second input signal 32*b*, a delay circuit from first signal 32*a*, such as an R-C (resistive-capacitive) circuit (not shown) can be used to provide a delay, followed by a Schmitt trigger to square up the signal.

Exemplary component values for ballast circuit 10 of FIG. 1 are as follows for fluorescent lamps 102 and 106 each rated at 25 watts, with a d.c. bus voltage of 360 volts:

Resonant inductor 17 800 micro henries

Resonant capacitor 104 7.7 nanofarads

Resonant capacitor 108 7.7 nanofarads

D.c. blocking capacitor 20 220 nanofarads

Bootstrap capacitors 43*a* and 43*b*, each 680 picofarads

Bias resistors 44 and 46, each 100k ohms

Zener diode 38 12 volts

Energy source capacitor 36 1 microfarad

Additionally, converter switch 15*n* may be an IRFR310, n-channel, enhancement mode MOSFET, sold by International Rectifier Company, of El Segundo, Calif.; converter switch 15*p*, an IRFR9310, p-channel, enhancement mode MOSFET also sold by International Rectifier Company; gate control switch pairs 22*p*, 22*n* and 23*p*, 23*n* , each 4000-series pair of drain-connected CMOS transistors, such as sold by Motorola of Phoenix, Ariz., or available as IRF9Z10-IRFZ10 CMOS pairs sold by International Rectifier Company. Finally, exemplary times T1, T2, T3 and T4 used by signal source 32 are, respectively, 6.5 microseconds, 1 microsecond, 6.5 microseconds, and 1 microseconds.

Figure 4:
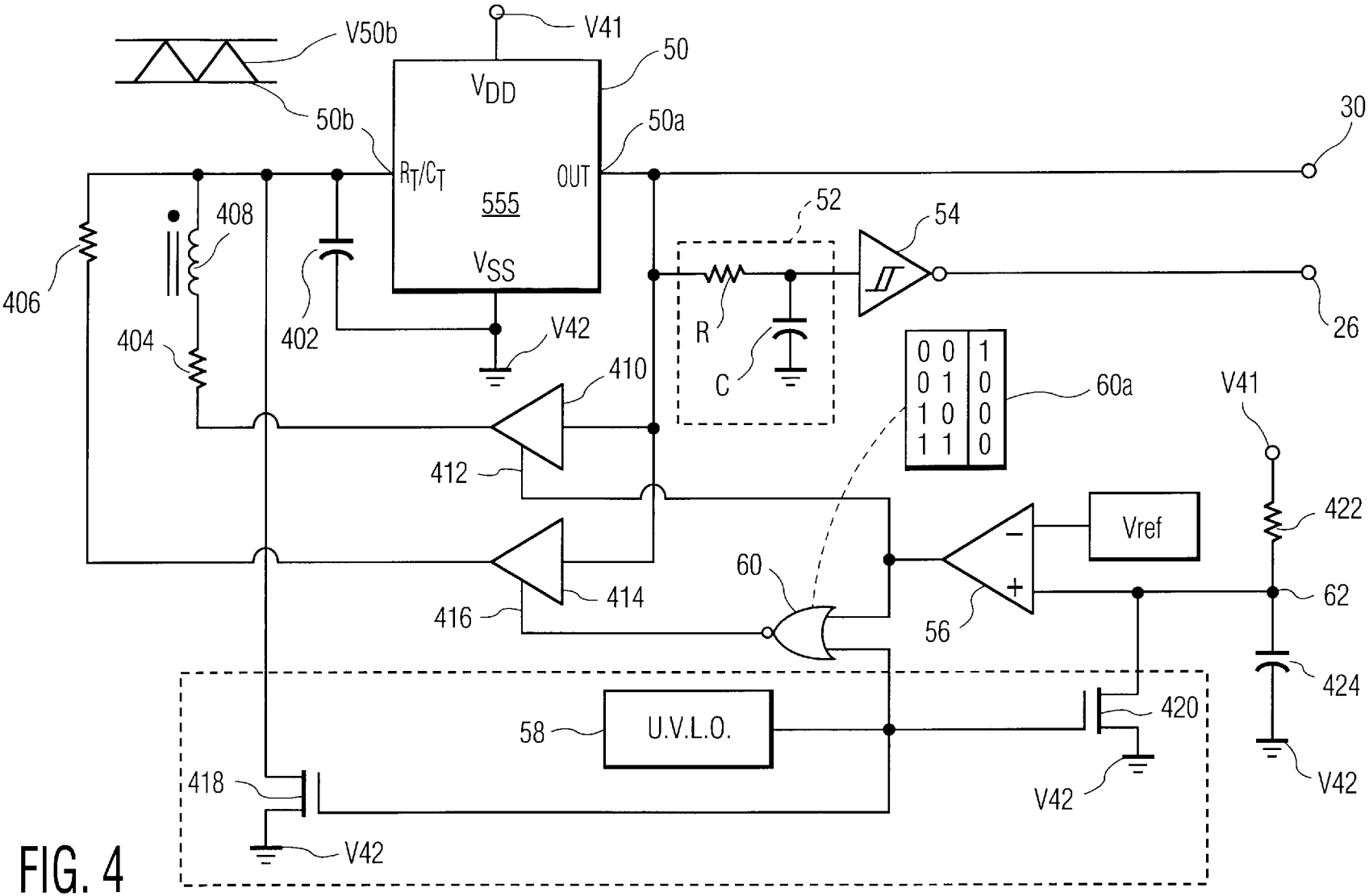
FIG. 4 is a schematic diagram, partially in block form, of an oscillator and associated circuitry for use in the circuit of FIG. 1 for the above-mentioned features of the second aspect of the invention relating to achieving desired starting and operating frequencies, and also a cathode preheat function.

FIG. 4 shows a preferred implementation of oscillator 32 and buffers 32*a* and 32*b* of FIG. 1, which may include a standard 555 IC timer 50. Timer 50 is powered, as shown, by the difference in voltage between voltage V41, the voltage or potential at node 41 of FIG. 1, and voltage V42, the voltage or potential at node 42. An output 50*a* timer 50 corresponds to output 30 of buffer 32*b* of FIG. 1. Output 26 of buffer 33*a* (FIG. 1) may be realized by delaying the signal on output 50*a* through an R-C circuit 52, and squaring the resulting signal by passing it through an inverting buffer 54, preferably with hysteresis. The output of buffer 54 is output 26.

A timing capacitor 402 is connected between a timing input 50*b* of timer 50 and the lower-shown node at voltage V42. Timing capacitor 402 cooperates with either timing resistor 404 or 406 to cause voltage V50*b* at timing input 50*b* to alternately decrease and increase between upper and lower voltage thresholds, as indicated in FIG. 3. When voltage V50*b* reaches one of the thresholds, the output of timer 50 changes state. Voltage V50*b* increases or decreases generally according to an R-C time constant set by the combination of timing capacitor 402 and one of timing resistors 404 or 406. When resistor 404 is coupled to timing input 50*b*, the excursion of voltage V50B is also influenced by the voltage induced on a feedback winding 408, which is coupled to resonant inductor 17 of FIG. 1, and poled with respect to that inductor as shown by the solid dots shown next to such items.

The selection of whether timing resistor 404 or 406 is to be coupled to timing input 50*a* may be determined with the use of tri-state buffers 410 and 414, which have enable inputs 412 and 416. The output of each tri-state buffer tracks its input (e.g., logic "1" or "0") when its enable input is at logic "1"; when its enable input is at logic "0", the output of the buffer is in its third, or high impedance state. For example, when enable input 416 is at a logic "0" state, buffer 414 provides a high impedance output, which decouples timing resistor 406 from timing input 50*a*. Control of the logic states of enable inputs 412 and 416 is preferably provided by logic circuitry including a preheat comparator 56 and an undervoltage lock-out (UVLO) circuit 58.

Figure 5:
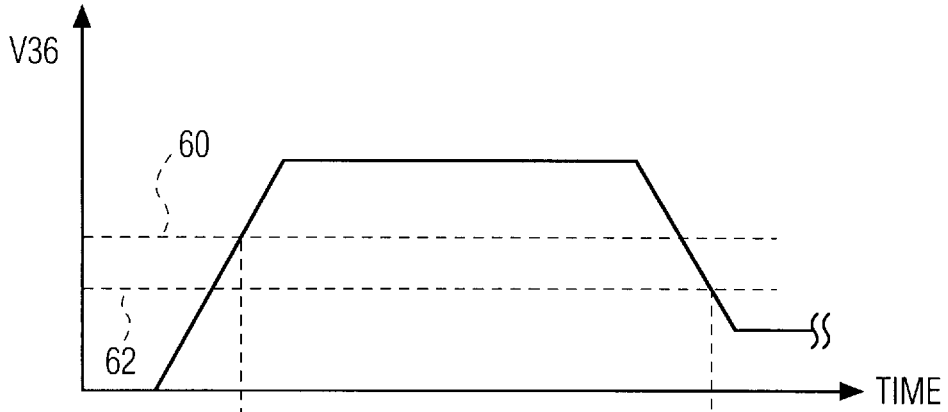
FIGS. 5 and 6 respectively show a voltage sensed by the undervoltage lock-out (UVLO) circuit of FIG. 4 and the logic level output of the UVLO circuit.
Figure 6:
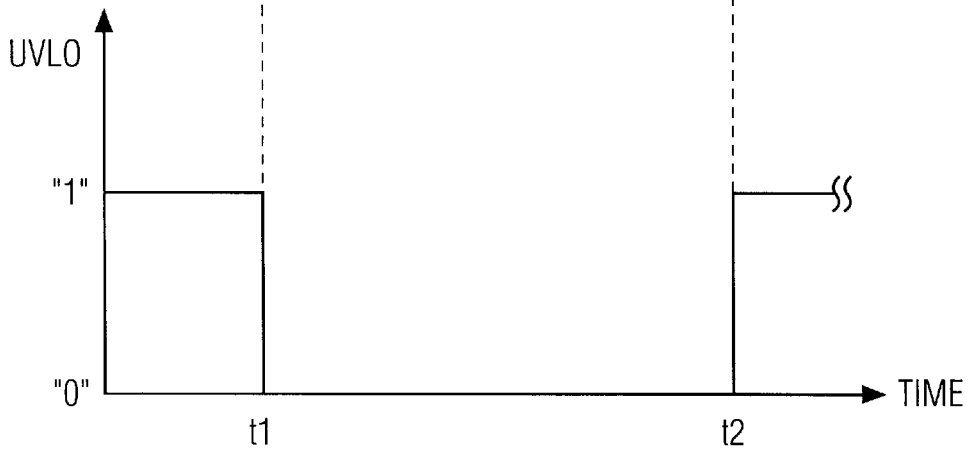

UVLO circuit 58 preferably senses voltage V36 across capacitor 36 of FIG. 1, which may supply energy for various functions (e.g., to power timer 50). As shown in FIGS. 5 and 6, when voltage V36 rises upon initial bus energization to a threshold level 60, at time t1, the logic-level output of UVLO circuit 58 changes from "1" to "0". When that voltage then decreases below another threshold level, 62, at time t2, the output of UVLO circuit 58 changes back to logic level "1". Threshold level 62 preferably differs from, and is less than, logic level 60, which imparts a range of hysteresis to the UVLO circuit.

Upon initial bus energization, UVLO circuit 58 produces an output of logic "1" (see FIGS. 5 and 6), which is applied to the gates of MOSFET switches 418 and 420, turning those switches on. As a result, switch 418 disables timer 50 by holding timing input 50B to voltage V42, and switch 420 keeps the positive input of preheat comparator 56 below a reference voltage Vref so that the comparator output is maintained at logic "0". At this time, the "1" output from the UVLO circuit is applied at the lower-shown input to a logic NOR gate 60. As a truth table 60*a* for NOR gate 60 shows, a logic "1" in either of the input columns (i.e., first two columns) results in a logic "0" output (third column). When the UVLO circuit senses adequate voltage on capacitor 36 (FIG. 1), its output goes to "0" and the output of NOR gate 60 goes to "1" according to the first row of truth table 60*a*, while switches Q1 and Q2 become disabled.

With NOR gate 60 providing a logic "1" to enable input 416, timing resistor 406 now becomes coupled between output 50*a* and input 50*b* of timer 50. The timer then starts to oscillate with a frequency determined by the R-C time constant of that resistor and capacitor 402. Such time constant is selected to prevent ignition of lamps 102 and 106 (FIG. 1) while their cathodes become resistively heated to a desired operating temperature. The duration of the cathode preheat period may be set by the serial combination of a preheat resistor 422 and a preheat capacitor 422 connected between voltage V41 and V42, with their intermediate node 62 connected to the positive input of preheat comparator 56. After switch 420 is disabled, preheat capacitor 424 starts to charge towards reference voltage Vref, and upon surpassing that reference voltage, causes, preheat comparator 56 to change its output to a logic "1". In turn, buffer 410 becomes enabled, and, as shown by the first two columns of truth table 60*a*, the output of NOR gate 60 switches to logic "0", disabling buffer 414. Then, the oscillation frequency of timer 50 becomes governed by timing resistor 404 in conjunction with the voltage developed across feedback winding 408.

Feedback winding 408 allows the frequency of operation of the resonant load circuit (FIG. 1) to migrate towards its natural resonant frequency. Before the lamp has started, when its resistance is quite high, operation at the natural resonant frequency results in a large voltage being impressed across the lamp, which is desirable for reliably starting the lamp. After the lamp has started, when its resistance falls to a much lower level, the natural resonant frequency of the load circuit typically migrates to a different operating frequency at a lower lamp voltage.

In particular, feedback winding 408 is preferably coupled to resonant inductor LR in such manner as to increase frequency of timer (or oscillator) 50 when current flowing into the resonant inductor from node 16 lags the voltage between common node 16 and reference conductor 14, and to decrease its frequency when such current leads such voltage.

Exemplary values for various components of FIG. 4 when using the above-mentioned component values for the circuit of FIG. 1, are as follows:

Timing resistor 404 7.5K ohms

Timing resistor 406 7.5K ohms

Resonant winding 17 (FIG. 1) 800 microhenries

Feedback winding 408 80 nanohenries

Feedback winding 408 turns 1

Resonant inductor 17 turns 100

Turns ratio between 17 and 408 100-to-1

Timing capacitor 402 1.0 nanofarads

Cathode preheat period 1.0 second

Additionally, tri-state buffers 410 and 414 may comprise part no. CD4503B, sold by National Semiconductor of Santa Clara, Calif.

Figure 7:
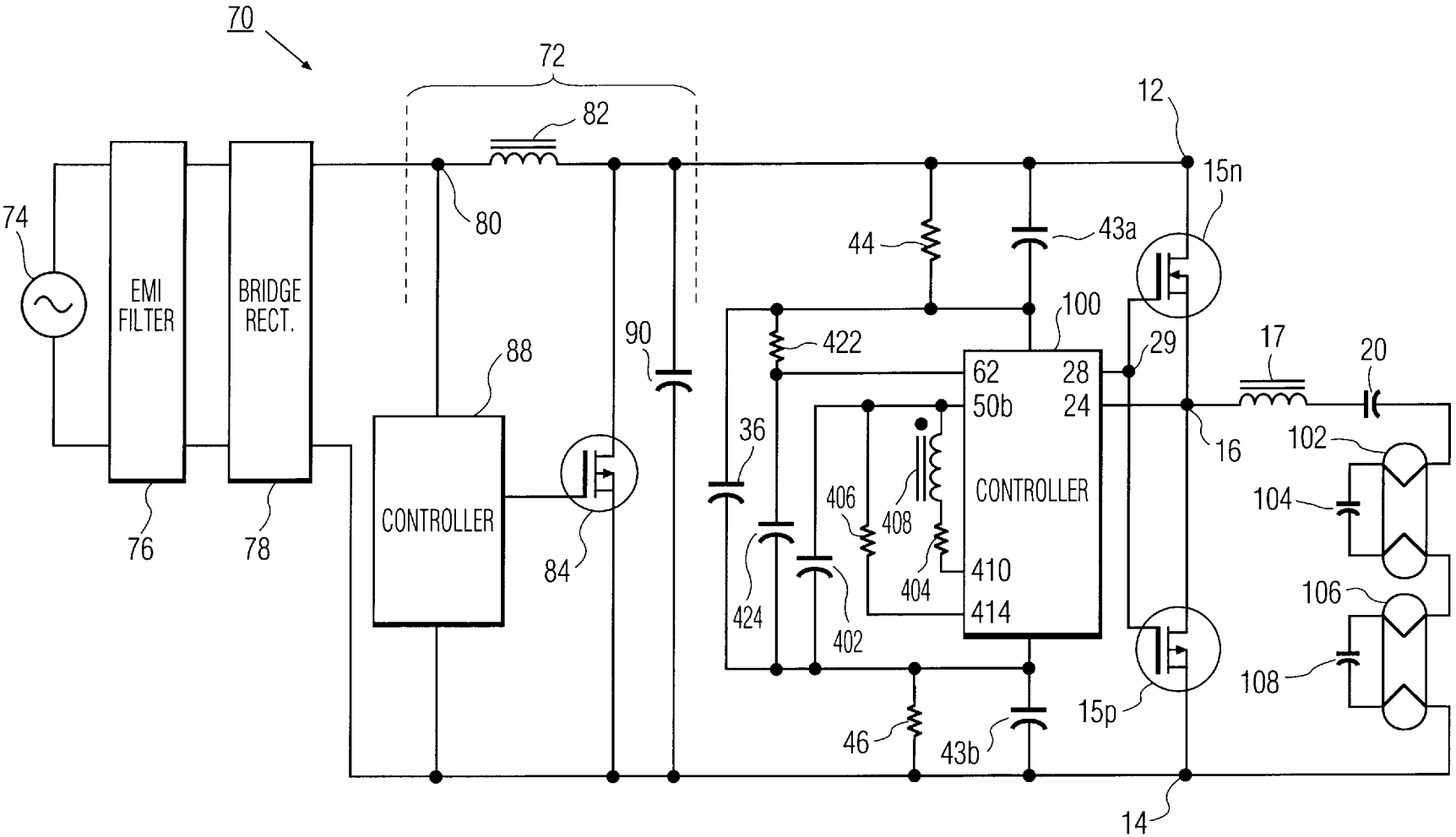
FIG. 7 is a schematic diagram, partially in block form, of a ballast circuit for achieving high power factor correction.

FIG. 7 shows a ballast circuit 70 employing a boost converter 72 for improving power factor correction. Like reference numerals as between FIG. 6 and the prior figures refer to like parts. A.c. power from a source 74 is preferably filtered by a standard electromagnetic interference (EMI) filter 76, and then rectified by a full-wave bridge rectifier 78. The rectifier supplies d.c. voltage between a node 80 and reference node 14. The right-shown node of a boost inductor 82 is intermittently coupled to node 14 by a boost switch 84. Switch 84 may be operated by a controller 88, such as power factor controller model no. KA7514A sold by Samsung Electronics of Seoul, South Korea, and associated biasing circuitry described in that company's CD-ROM (Edition 3.0) published in 1996. For simplicity, current- and voltage-sensing resistors have been omitted from FIG. 7.

When switch 84 conducts, boost inductor 82 draws significant current and accumulates energy. When switch 84 stops conducting, the energy stored in the inductor is transferred to a boost capacitor 90.

Switches 15*n* and 15*p* may be operated by a controller 100 in a hybrid or monolithic integrated circuit form. Controller 100 incorporates the circuitry enclosed within dashed-line box 39 of FIG. 1, as well as much of the circuitry shown in FIG. 4. Inputs 62, 50*b* correspond to the like-numbered nodes in FIG. 4; inputs 410 and 414 correspond to the left-shown nodes of tri-state buffers 410 and 414 in FIG. 4; and inputs 24 and 28 correspond to the like-numbered nodes in FIG. 1.

Beneficially, no isolation transformer is required in the ballast circuit of FIG. 7. When a lamp is removed from the circuit, the output voltage is kept withing normal operating bounds. If a lamp breaks, the ballast circuit produces enough current to open up (i.e., bum out) the lamp cathodes, thus limiting the output voltage.

Exemplary values for boost inductor 82 and boost capacitor 90 of FIG. 7, when using the above-mentioned component values for the circuits of FIGS. 1 and 4, with a 50-watt load operating at 50 kilohertz, are, respectively, 1.2 millihenries and 22 microfarads.

While the invention has been described with respect to specific embodiments by way of illustration, many modifications and changes will occur to those skilled in the art. For instance, in some applications it may be desirable to delete capacitor 36 and Zener diode 38 and associated circuitry for keeping capacitor 36 charged. In such case, a separate power source such as a battery could be provided for supplying power to one or both of signal source 32 and buffers 33*a* and 33*b*. It is therefore, to be understood that the appended claims are intended to cover all such modifications and changes as fall within the true spirit and scope of the invention.

What is claimed is:

1. A gas discharge ballast circuit, comprising:

(a) a resonant load circuit including a resonant inductance, a resonant capacitance, and means for connection to at least one gas discharge lamp;

(b) a d.c.-to-a.c. converter circuit coupled to said resonant load circuit for inducing an a.c. current in said resonant load circuit, said converter circuit comprising:

(i) first and second converter switches serially connected in the foregoing order between a bus conductor at a d.c. voltage and a reference conductor, and being connected together at a common node through which said a.c. load current flows;

(ii) said first and second converter switches each comprising a control node and a reference node, the voltage between such nodes determining the conduction state of the associated switch;

(iii) the respective control nodes of said first and second converter switches being interconnected; and (iv) the respective reference nodes of said first and second converter switches being connected together at said common node;

(c) a bridge network connected between first and second nodes and having:

(i) first and second input nodes on which respective first and second input signals are applied; and (ii) first and second output nodes respectively connected to said common and control nodes so as to control the switching state of said converter switches;

(d) an oscillator for providing said first and second input signals; said oscillator having a timing input and an output;

(e) a boost capacitor coupled between said bus and reference conductors;

(f) a boost inductor coupled to supply energy to said boost capacitor; and (g) a boost switch for intermittently coupling one end of said boost inductor between said bus and reference conductors so as to store energy in said inductor.

2. The ballast circuit of claim 1, further including a first resistor and a serially connected feedback winding coupled to said timing input; said feedback winding being coupled to said resonant inductance so as to increase frequency of said oscillator when current in said resonant inductance from said common node lags the voltage between said common node and said reference conductor, and to decrease said frequency when said current leads said voltage.

3. The ballast circuit of claim 2, further comprising:

(a) a second resistor coupled to said timing input so as to set the frequency of said oscillator at a level that generates an appropriately large starting voltage across said lamp; and (b) control circuitry for decoupling said first resistor from said timing input while coupling said second resistor to said timing input during a predetermined preheat period, in which cathodes of said lamp become heated.

4. The ballast circuit of claim 2, wherein frequency of said oscillator is determined by the time for the voltage at its timing input to change between first and second levels.

5. The ballast circuit of claim 4, wherein said output of said oscillator is coupled to said timing input through said first resistor.

6. The ballast circuit of claim 1, wherein said oscillator is arranged to cause repetitive cycling between first input signal-second input signal pairs of at least high-low, high—high, low-high, and low—low states.

7. A gas discharge lamp ballast circuit, comprising:

(a) a resonant load circuit including a resonant inductance, a resonant capacitance, and means for connection to at least one gas discharge lamp;

(b) a d.c.-to-a.c. converter circuit coupled to said resonant load circuit for inducing an a.c. current in said resonant load circuit, said converter circuit comprising:

(i) first and second converter switches serially connected in the foregoing order between a bus conductor at a d.c. voltage and a reference conductor, and being connected together at a common node through which said a.c. load current flows;

(ii) said first and second converter switches each comprising a control node and a reference node, the voltage between such nodes determining the conduction state of the associated switch;

(iii) the respective control nodes of said first and second converter switches being interconnected; and (iv) the respective reference nodes of said first and second converter switches being connected together at said common node;

(c) said first node being connected to said bus conductor through a bootstrap capacitor, and said second node being connected to said reference conductor through a bootstrap capacitor; and (d) a bridge network connected between said first and second nodes and having:

(i) first and second input nodes on which respective first and second input signals are applied; and (ii) first and second output nodes respectively connected to said common and control nodes so as to control the switching state of said converter switches;

(e) an oscillator for providing said first and second input signals; said oscillator having a timing input and an output;

(f) said bridge network being arranged to cause repetitive cycling through at least the following states of said first and second converter switches respectively being:

(i) on and off;

(ii) turned off and already off, and residual energy of said resonant inductance causing a shift in energy from one of said bootstrap capacitors to the other of said bootstrap capacitors via said energy source, thereby replenishing said source with energy;

(iii) off and on;

(iv) already off and turned off, and residual energy of said resonant inductance causing a shift in energy from said other of said bootstrap capacitors to said one of said bootstrap capacitors via said energy source, thereby replenishing said source with energy;

(g) a boost capacitor coupled between said bus and reference conductors;

(h) a boost inductor coupled to supply energy to said boost capacitor; and (i) a boost switch for intermittently coupling one end of said boost inductor between said bus and reference conductors so as to store energy in said inductor.

8. The ballast circuit of claim 7, further including a first resistor and a serially connected feedback winding coupled to said timing input; said feedback winding being coupled to said resonant inductance so as to increase frequency of said oscillator when current in said resonant inductance from said common node lags the voltage between said common node and said reference conductor, and to decrease said frequency when said current leads said voltage.

9. The ballast circuit of claim 8, further comprising:

(a) a second resistor coupled to said timing input so as to set the frequency of said oscillator at a level that generates an appropriately large starting voltage across said lamp; and (b) control circuitry for decoupling said first resistor from said timing input while coupling said second resistor to said timing input during a predetermined preheat period, in which cathodes of said lamp become heated.

10. The ballast circuit of claim 7, wherein frequency of said oscillator is determined by the time for the voltage at its timing input to change between first and second levels.

11. The ballast circuit of claim 8, wherein said output of said oscillator is coupled to said timing input through said first resistor.

12. The ballast circuit of claim 7, wherein said oscillator is arranged to cause repetitive cycling between first input signal-second input signal pairs of at least high-low, high-high, low-high, and low-low states.

13. The ballast circuit of claim 7, wherein said bridge circuit comprises:

(a) a first pair of gate control switches connected between said first and second nodes, having complementary conduction modes which change in response to a first input signal applied to commonly connected control nodes of said switches, and being connected together serially at said first output node; and (b) a second pair of gate control switches connected between said first and second nodes, having complementary conduction modes which change in response to a second input signal applied to commonly connected control nodes of said switches, and being connected together serially at said second output node.

14. The ballast circuit of claim 13, wherein said first and second pairs of gate control switches comprise drain-connected CMOS transistors, with like-conduction mode transistors being connected to said first node.

15. The ballast circuit of claim 7, further including means to power said oscillator and to supply power to control said bridge network from said energy storage source.

16. The ballast circuit of claim 15, wherein at least said first and second pairs of control switches and said oscillator are contained in an integrated circuit.

17. The ballast circuit of claim 16, wherein said energy source contains a Zener diode for voltage-limiting purposes, said Zener diode also being contained in said integrated circuit.

18. The ballast circuit of claim 16, wherein said first and second converter switches are also contained in said integrated circuit.

* * * * *